US005902518A

United States Patent [19]

Khazai et al.

[11] Patent Number: 5,902,518

[45] Date of Patent: May 11, 1999

[54] SELF-REGULATING POLYMER COMPOSITE HEATER

[75] Inventors: Bijan Khazai, Chesterfield, Mo.; George M. Nichols, Willmette, Ill.

[73] Assignees: Watlow Missouri, Inc., Fenton, Mo.; Northwestern University, Evanston, Ill.

[21] Appl. No.: 08/902,122

[22] Filed: Jul. 29, 1997

[51] Int. Cl.[6] ..... H01B 1/06

[52] U.S. Cl. ..... 252/511; 252/500; 252/502; 219/553

[58] Field of Search ..... 252/500, 502, 252/503, 506, 510, 511, 512, 513, 514, 515, 518

[56] References Cited

U.S. PATENT DOCUMENTS

| | | | |
|---|---|---|---|
| 4,237,441 | 12/1980 | Van Konynenburg et al. | 338/22 R |
| 4,304,987 | 12/1981 | van Konyenburg . | |
| 4,388,607 | 6/1983 | Toy et al. . | |
| 4,514,620 | 4/1985 | Cheng et al. . | |
| 4,526,952 | 7/1985 | Zeitler et al. . | |
| 4,545,926 | 10/1985 | Fouts, Jr. et al. . | |
| 4,569,880 | 2/1986 | Nishiyama et al. | 428/212 |
| 4,658,121 | 4/1987 | Horsma et al. . | |
| 4,702,860 | 10/1987 | Kinderov et al. | 252/511 |
| 4,882,446 | 11/1989 | Friel . | |
| 4,951,384 | 8/1990 | Jacobs et al. . | |
| 4,966,729 | 10/1990 | Carmona et al. . | |
| 4,980,541 | 12/1990 | Shafe et al. . | |
| 5,049,591 | 9/1991 | Hayashi et al. . | |
| 5,057,674 | 10/1991 | Smith-Johannsen . | |
| 5,093,384 | 3/1992 | Hayashi et al. . | |
| 5,106,540 | 4/1992 | Barma et al. . | |
| 5,126,425 | 6/1992 | Sasagawa et al. | 528/58 |
| 5,145,935 | 9/1992 | Hayashi et al. . | |
| 5,155,199 | 10/1992 | Hayashi . | |
| 5,178,797 | 1/1993 | Evans . | |
| 5,250,226 | 10/1993 | Oswal et al. . | |
| 5,314,928 | 5/1994 | Verhelst | 521/159 |
| 5,344,591 | 9/1994 | Smuckler . | |
| 5,382,384 | 1/1995 | Baigrie et al. . | |
| 5,407,741 | 4/1995 | Ota . | |
| 5,415,934 | 5/1995 | Mori . | |
| 5,478,619 | 12/1995 | Fujikura et al. | 428/36.91 |
| 5,580,493 | 12/1996 | Chu et al. . | |

FOREIGN PATENT DOCUMENTS

| | | |
|---|---|---|
| 0581541A1 | 2/1994 | European Pat. Off. . |

*Primary Examiner*—Mark Kopec
*Assistant Examiner*—John M. Petauncio
*Attorney, Agent, or Firm*—Herzoq, Crebs, & McGhee, LLP

[57] ABSTRACT

A polymer matrix type heater filled with a conductive particulate moiety is disclosed wherein the preferable polymer is a polyurethane shape-memory polymer and the preferable filler is spherical thermal carbon black particles. Optional insulating fillers may be added to adjust the thermal and electrical properties of the heater. The resulting self-regulating heater has fast heat-up, sharp turnoff, and negligible temperature fluctuation.

14 Claims, 5 Drawing Sheets

SELF-REGULATING POLYMER COMPOSITE HEATER

FIELD OF THE INVENTION

The present invention relates to heaters, and more particularly to a polymer heater which is self-regulating.

BACKGROUND OF THE INVENTION

It is well known in the art that combining a conventional polymer with an electrically conductive filler can create an electrically conductive composition which exhibits a positive temperature coefficient of resistivity ("PTC"). By way of example, U.S. Pat. No. 4,966,729 to Carmone et al. teaches a conductive PTC polymer which can be an epoxy resin, polyimide, unsaturated polyester, silicone, polyurethane, or phenolic resin doped with fiber shaped conductive materials. The fibers can be carbon fibers, carbon fibers coated with a metal or an alloy, graphite fibers, graphite fibers coated with a metal or an alloy, graphite intercalation compound fibers, metal fibers, ceramic fibers, or ceramic fibers coated with a metal or an alloy. The material is characterized by the fact that the plastic material of the matrix is a thermosetting resin rather than a thermoplastic polymer. The conductive particles preferably have a large size (>1 micron) and are in fibrous form. U.S. Pat. No. 4,658,121 to Horsma et al. describes self-regulating PTC compositions with reduced thermal runaway problems, comprising a cross-linked elastomer, a thermoplastic polymer, and carbon black. The elastomer component may be polyurethane. The carbon filler is identified as Vulcan XC-72, a high surface area species. U.S. Pat. No. 4,545,926 to Fouts, Jr. et al. reveals conductive polymer compositions comprising a polymeric material having dispersed therein conductive particles composed of a highly conductive material and a particulate filler. Fouts teaches the use of carbon black with an average particle size between 0.01 and 0.07 microns.

The PTC property of the composition means that as the temperature of the composition rises, so does the internal resistance thereof. For many of these substances, the flow of electric current therethrough causes the temperature of the material to rise through Joules heating, and therefore the resistance. As the temperature rises, the polymer matrix expands, causing the conductive moieties (usually carbon black) to lose contact with one another. The electrical resistance thus rises, eventually creating conditions similar to an open circuit. The resulting rise in resistance is greater than would be seen in a conventional resistive heating medium.

These characteristics make the composition suitable for many applications including heaters, sensors, and switches. Essentially, when a voltage is applied, the composition emanates internally generated heat, which simultaneously causes the resistance therein to rise. As the resistance rises, the current flowing through the composition is reduced. Eventually, the composition reaches a temperature at which the current is almost completely cutoff, preventing the composition from getting any hotter than the temperature at the current cutoff level.

These compositions that are most suitable for heaters have a certain critical temperature at which point the thermal coefficient of resistivity becomes very large. This creates a turnoff effect for the heater at the critical temperature. The more distinct the change in the thermal coefficient of resistivity, the sharper the turnoff effect for the heater. Despite many advances in the art, the change in the thermal coefficient of resistivity of existing compositions is still far short of ideal. The prior art heaters do not have a sharp turnoff effect. Also the prior art carbon filled polymer matrix heaters exhibit fluctuations in temperature even after the turnoff point is reached.

It is thus an object of the present invention to provide an electrically conductive polymer composition for a heater that exhibits a positive temperature coefficient of resistivity.

It is a further object of the present invention to provide such a composition that has a narrow range of temperatures in which the composition changes from conductive to resistive.

It is yet a further object of the present invention to provide such a composition that exhibits negligible fluctuations in temperature once a critical temperature is reached.

Other objects of the invention will become apparent from the specification described herein below.

SUMMARY OF THE INVENTION

In accordance with the objects listed above, the present invention is a heater made of a composition that preferably uses a polymer matrix, or foundation, with embedded conductive particles. Preferably, the conductive particles dispersed throughout the polymer matrix are thermal carbon black. The preferred thermal carbon black particles of the present invention are essentially spherical particles between 0.1 and 0.8 microns in diameter and having a dibutylphthalate absorption rating below 50 $cm^3$ per 100 grams of carbon. While a wide selection of polymers can be utilized as the matrix, one preferred polymer matrix is known as polyurethane, and more specifically a shape-memory polymer ("SMP") polyurethane. A polyurethane SMP as may be used in the present invention is disclosed in U.S. Pat. No. 5,049,591 to Hayashi et al, the disclosure of which is incorporated herein by reference.

In one preferred embodiment, using both the spherical thermal carbon black particles with the polyurethane SMP, the composition and corresponding heater exhibit excellent self-regulation properties. To further adjust those properties, such as heat-up time and maximum temperature, other insulating additives, or polymers, may be added. Adjusting the ratio of conductive particles to polymer also modifies the electrical and thermal properties.

The heater composition is formed by blending or melt-blending the base polymer of the type described above and any additive polymers. The conductive particles are mixed in over a period of time to ensure even dispersion. The composition is cooled and shaped, possibly by hot pressing, and electrodes are attached thereto.

When spherical thermal carbon black particles with the properties described above are used, the resulting heaters tend to show almost no further increase in temperature after the turnoff point is reached. This is presumably due to the absence of strong mechanical entanglement of the conductive agglomerates, such as those used in the prior art. This phenomenon allows for rapid disengagement and separation of carbon particles upon attainment of critical volume expansion, the point at which self-regulation of the heater is initiated. As a result, a heater made in accordance with the specifications of the present invention, can achieve operating temperature in a shorter period of time with essentially no dependence upon the voltage, beyond the turn off point.

When polyurethane SMP is used, the resulting heater can be made to operate at lower temperatures, in the regions of the glass transition of the polymer. This is presumably due to a large and sharp increase in the volume of the polymer in the glass transition region. SMPs have a transition at which point the substance changes from a glassy phase to a rubbery phase. This transition is also accompanied by a sharp reduction in the modulus of elasticity of the polymer over a narrow temperature range, often less than 15° C. Variation in the modulus of elasticity with temperature is thought to contribute to the abnormally high volume expansion in the glass transition region. Therefore, a medium is provided in which the conducting particles can connect and disconnect with the expansion and contraction of the composite matrix.

DETAILED DESCRIPTION OF THE INVENTION

Figure 1:
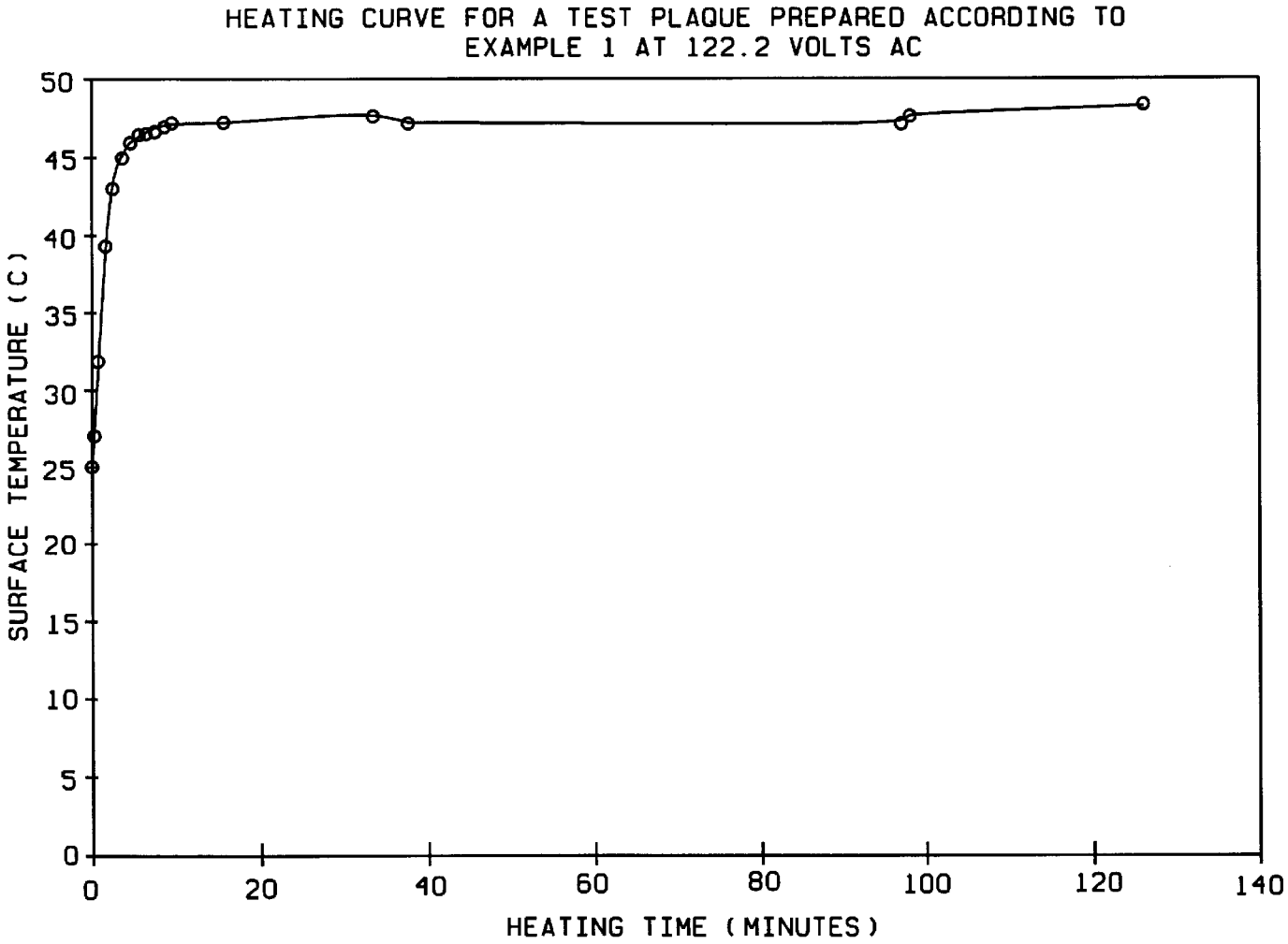
FIGS. 1, 2, 4, and 5 are graphs showing temperature versus time during heat-up of example heaters, detailed below, in accordance with the principles of the present invention.

The present heater is made from a composition formed by melting a polymer and mixing in electrically conductive carbon black particles. Useful mixing processes are discussed later. Although a wide variety of polymers can serve as the matrix, the preferable polymer is a polyurethane SMP. Other polymers may be used, however SMPs, and more specifically polyurethane SMPs have been found to have particular advantages depending on the desired operating conditions of the heaters. For example, SMPs are particularly useful for low temperature heater applications, and polyesters such as polyethylene terephthalate (PET) are particularly useful for higher temperature heater applications. The nature of the conductive carbon is especially important for achieving superior self-regulating characteristics. The preferred carbon is a medium thermal carbon black with spherical particles predominantly between 0.1 and 0.8 microns in diameter.

While a wide selection of polymers may be used, one preferred polymer is a polyurethane SMP. The special advantage of using SMPs is that they exhibit a large, discontinuous increase in volume within the glass transition region, essentially occurring below 100° C. As a result, polyurethane SMPs not only can allow for the operation of the resultant heaters at lower temperatures, but, they can also aid in adjusting response temperature characteristics of other polymer systems used in the present invention.

Below a certain transition temperature, the polymer is in a glassy state. There should be sufficient carbon black dispersed throughout such that the carbon black particles touch one another (see examples below). This forms electrically conductive pathways throughout the polymer matrix, held in place by the physical characteristics of the polymer. When the polymer is heated by the passage of electric current to certain temperatures, the modulus of elasticity decreases. Polymer molecular motion increases, the polymer molecules become more distant and the polymer composite expands. This causes the carbon black particles to lose contact with one another, thereby destroying the electrically conductive pathways. In this manner the flow of electric current through the heater ceases so there is no additional heat produced until the temperature thereof lowers slightly. Through this expansion and contraction the heater thus formed tends to regulate its thermal state, thus exhibiting self-regulation.

Specifically, the use of spherical thermal carbon black particles precludes formation of strong mechanical entanglements of the agglomerates to a much greater extent than that observed in other prior art polymer-carbon black composite heaters. The preferred thermal carbon black particles have a dibutylphthalate absorption rating below 50 $cm^3$ per 100 grams of carbon black, and a nitrogen surface area between 7 and 12 $m^2$ per gram of carbon black. The largely unentangled thermal carbon black particles causes the electrical pathways to disappear more nearly simultaneously when the polymer composite heater enters its turnoff temperature region.

The use of a polyurethane SMP provides a relatively low and narrow temperature region with an accompanying large volume change. This allows for a rapid separation of the conducting particles at a low temperature. When used in a heater designed to operate at low temperatures, the volume expansion of the polymer composite system is predominantly controlled by the sharp and large discontinuity of the polymer in the glass transition region, and the glass transition temperature predominantly determines the self-regulating characteristics of the heater. Preferably, the polyurethane SMP should have a glass transition temperature region of 15° C. or less. The polyurethane SMP also exhibits a sharp downward discontinuity in its modulus of elasticity in its glass transition temperature region. Preferably, the modulus of elasticity should change by a factor of 200 or more within a temperature range of 20° C. In the same glass temperature region the polymer undergoes a sudden and pronounced volume expansion. When used in heaters operating at low temperatures, once the composite system reaches the glass transition temperature region of the polymer, it transforms from being electrically conducting to electrically insulating. Other electrically insulating additives or polymers may be optionally added to the matrix polymer to alter the characteristics of the polymer composite, and in turn the heater. The additives or polymers, to have a pronounced effect, may exhibit a phase transition when heated. Other useful polymers include polyester, high density polyethylene, other polyolefins, polyamide, polysiloxane, and epoxy. These additional polymers may be used in place of the polyurethane SMP, however, the SMP is preferred at lower operating temperatures.

The polymer and thermal carbon black may either be blended or melt blended together. The blending or melt blending may be done on a roll mill, in a melt-mixing chamber, in an extruder, or using any other similarly known technique. The mixing should take place at a sufficient temperature to accomplish an even dispersion of the components. Examples of such are given below.

The mixture is then formed into a desired shape using any conventional technique, such as compression or injection molding or extrusion. Electrodes are then added, possibly by hot pressing or metallization techniques. If the shaping is done by extrusion, the electrodes may be optionally attached by coextrusion. The electrodes may be made of any conventional conductive materials. Typical materials include aluminum, copper, nickel, zinc, steel, tungsten, molybdenum, and platinum. A conductive rubber or ceramic may also be used for forming the electrodes.

EXAMPLE 1

The simplest example of the preferred embodiment uses a half-and-half mixture of polyurethane SMP, sold as MM-3510 by Mitsubishi of Tokyo, Japan, and spherical medium thermal carbon black, sold as Thermax® Floform N-990 by Cancarb Ltd. of Alberta, Canada. 75 g of the polyurethane SMP was fluxed onto a 3-inch-diameter roll mill at 204° C. 75 g of the thermal carbon black was gradually mixed into the molten polyurethane SMP over a 20 minute period to obtain a uniform mixture of the components. The resultant blend was removed from the mill and cut into pieces appropriate for test sample preparation. Test samples in the form of flat 5 inch square, 1/16 inch thick plaques were prepared by hot pressing in a mold at 220° C. under a force of five tons. Zinc electrodes were sprayed on both faces of the plaques. The heaters were then energized by the application of power to the electrodes thus formed.

FIG. 1 shows a graph of the temperature versus time for one of the plaques when 122.4 volts AC was applied thereto from room temperature. As can be seen by the graph of FIG. 1, the temperature rises above 39° C. within 120 seconds, 43° C. within 180 seconds, and never rises above 48° C.

The glass transition temperature region for the composition of Example 1, as seen in FIG. 1, is apparently between approximately 35° and 48° C. Presumably, when the temperature of the heater approaches this region, the polymer matrix rapidly expands causing the carbon black particles to separate. It is theorized that the uniform spherical shape, small size, and even dispersion of the carbon black particles, causes the electrical pathways to disappear more or less simultaneously when compared to either the aggregate carbon black clumps, or the high aspect ratio fibers, of prior art heaters.

EXAMPLE 2

Figure 2:
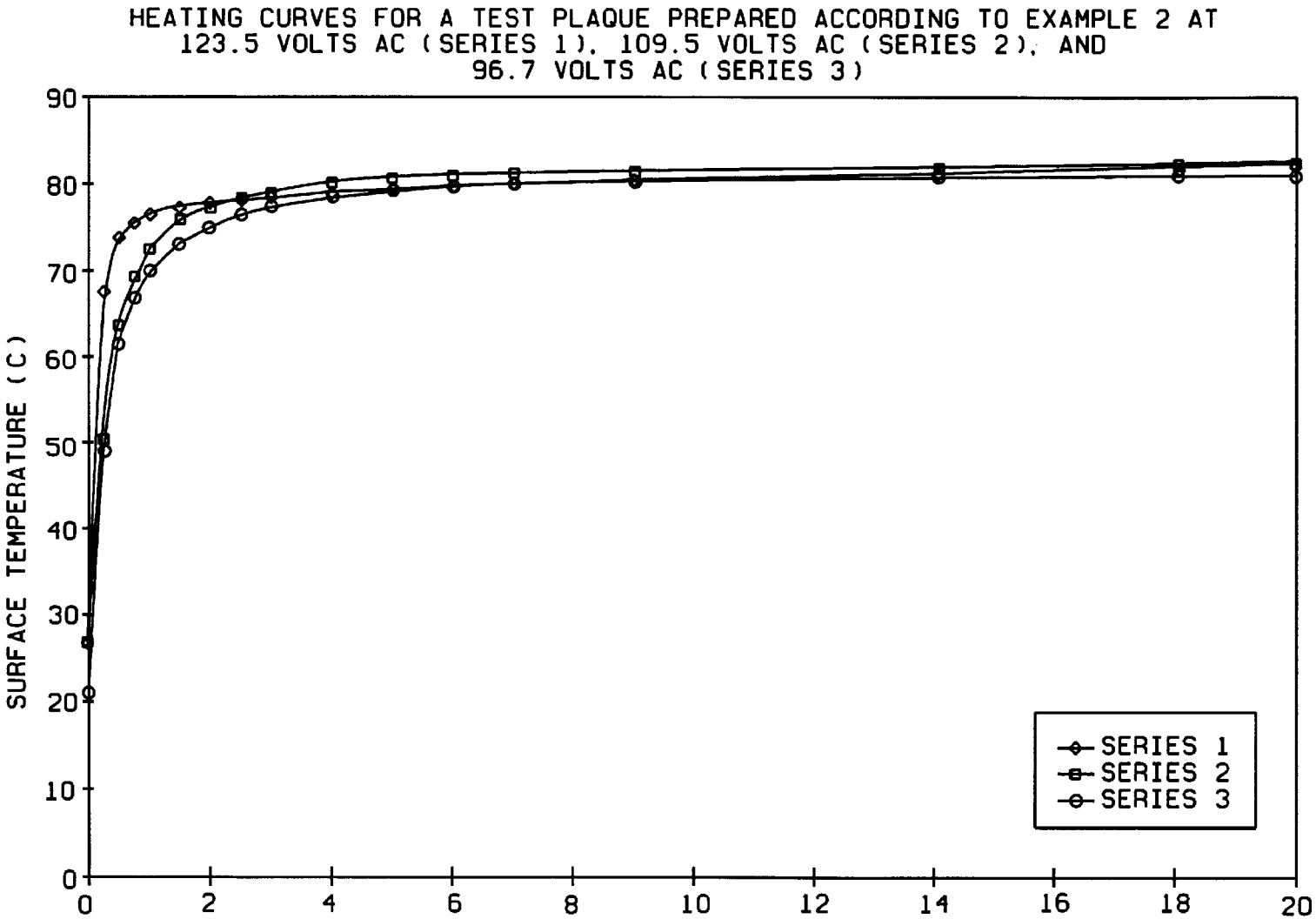

63 g of the polyurethane SMP and 87 g of the thermal carbon black were melt blended as in Example 1. Five inch square by 1/16 inch thick plates were prepared by hot pressing in a mold at 220° C. under a force of five tons. Aluminum foil electrodes were attached by placing a sheet of foil on the bottom and top of the mold while hot pressing. Different levels of AC electric power were then applied to one such specimen heater and temperature was monitored versus time. FIG. 2 illustrates the heating behavior of the element as described and tested. It is seen that the turnoff temperature is essentially independent of applied voltage as measured between 96.7–123.5 volts AC, remaining practically constant at 82° C. In contrast, a prior art heater, while apparently slowing down at its turnoff point, continues to rise in temperature as the applied electric load on it is increased.

Figure 3:
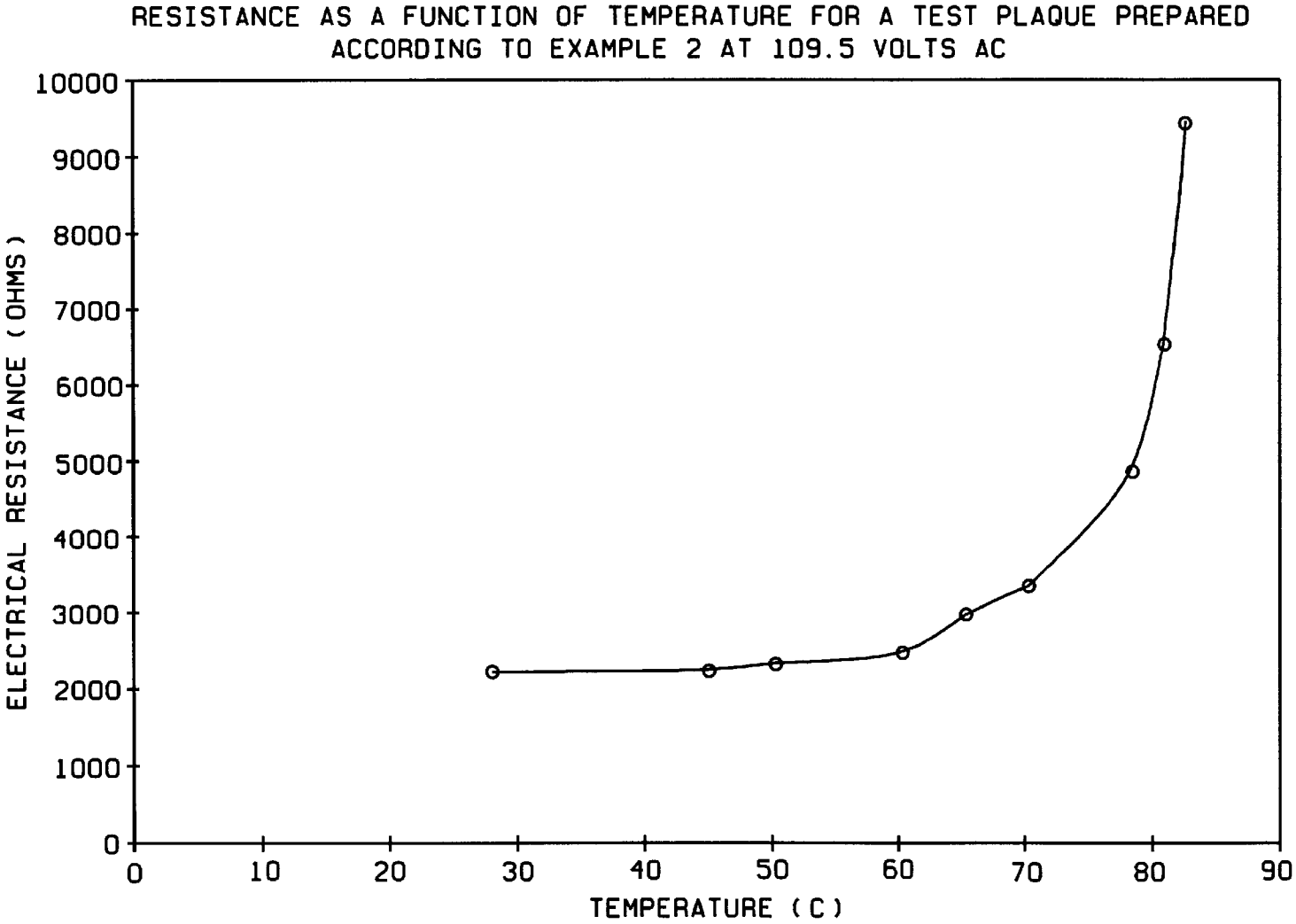
FIG. 3 is a graph showing the resistance versus temperature of an example heater, detailed below, in accordance with the principles of the present invention.

It is further seen that a heater according to the present example attains greater than 90% of its final temperature in less than one minute. FIG. 3 is a representation of the variation in resistance with temperature of one of the test specimens of the present example. It is seen that the resistance shows a five-fold increase over a 10° C. temperature range, as it nears the transition point.

EXAMPLE 3

The characteristics of Example 2 are modified by replacing the 75 g of polyurethane SMP with 20 g of polyurethane SMP and 55 g of nylon 12. The nylon was first fluxed onto the roll mill followed by the polyurethane SMP. The remainder of the preparation was identical to that of Example 2.

Figure 4:
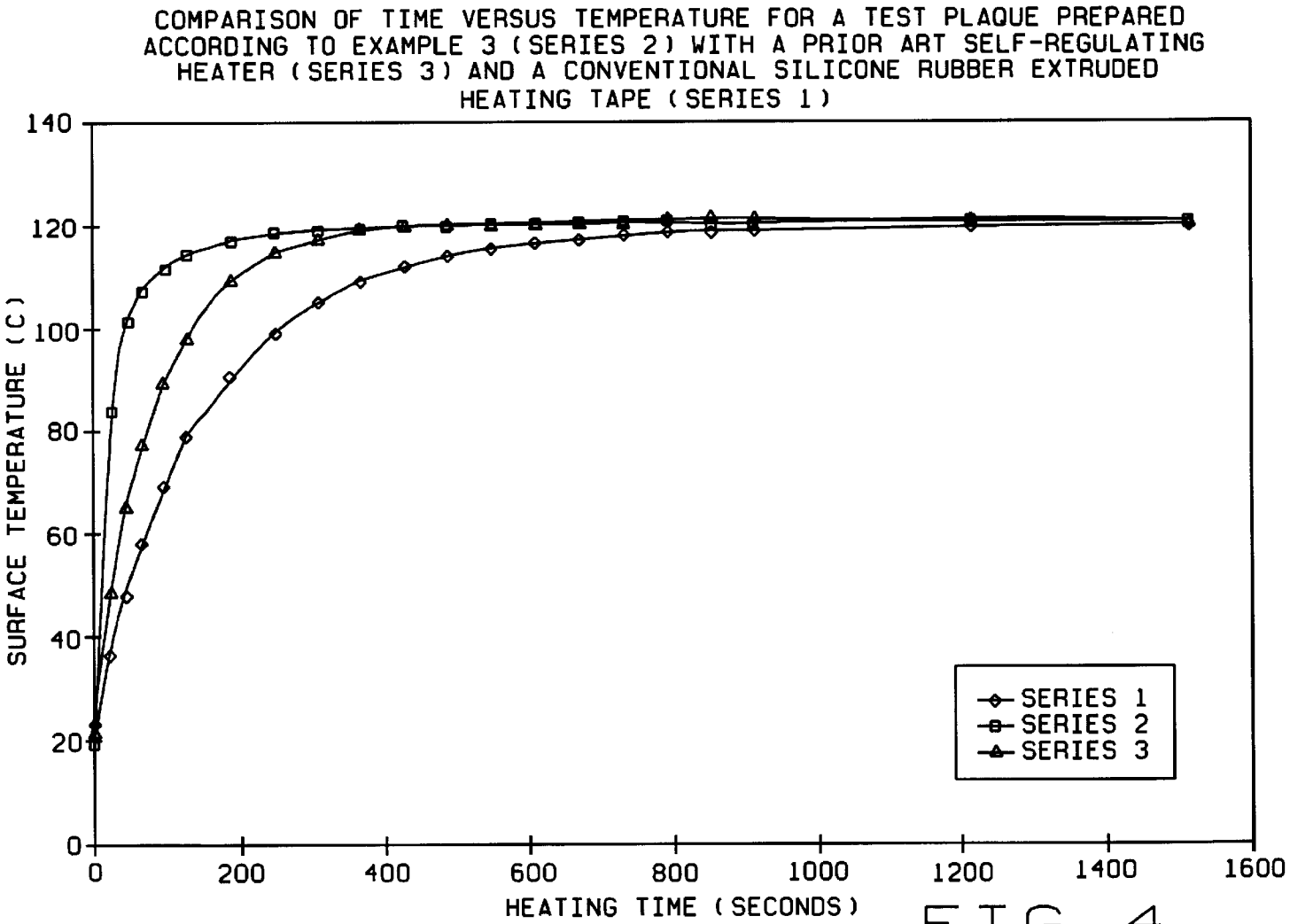

FIG. 4 shows this composition exhibits a higher turnoff temperature than the composition of Example 1. The graph in FIG. 4 compares the temperature versus time graphs for heat-up from room temperature of a sample made according to Example 3 with those of a prior art "self-regulating" heater and a conventional heating tape made from extruded silicone rubber. For the measurements in FIG. 4, 105.5 volts AC were applied to each heater sample. As seen from the graph, the temperature of the heater made according to the present invention rises to its final turnoff temperature very quickly, reaching 95% of the turnoff temperature within 120 seconds, with no significant temperature fluctuations thereafter.

EXAMPLE 4

Example 4 shows an alternative embodiment that uses the medium thermal carbon black with a conventional (non-shape-memory) polymer. The sample was prepared by fluxing 75 g of polyethylene terephthalate onto a 3-inch-diameter roll mill at 260° C. 65.5 g of the medium thermal carbon black (Thermax®) and 9.5 g of 1,3,5-triphenyl benzene were gradually mixed into the polyethylene terephthalate over a twenty minute period to obtain a uniform mixture of the components. The resultant blend was formed into heaters using the same method of Example 2, except the hot pressing was performed at 275° C.

Figure 5:
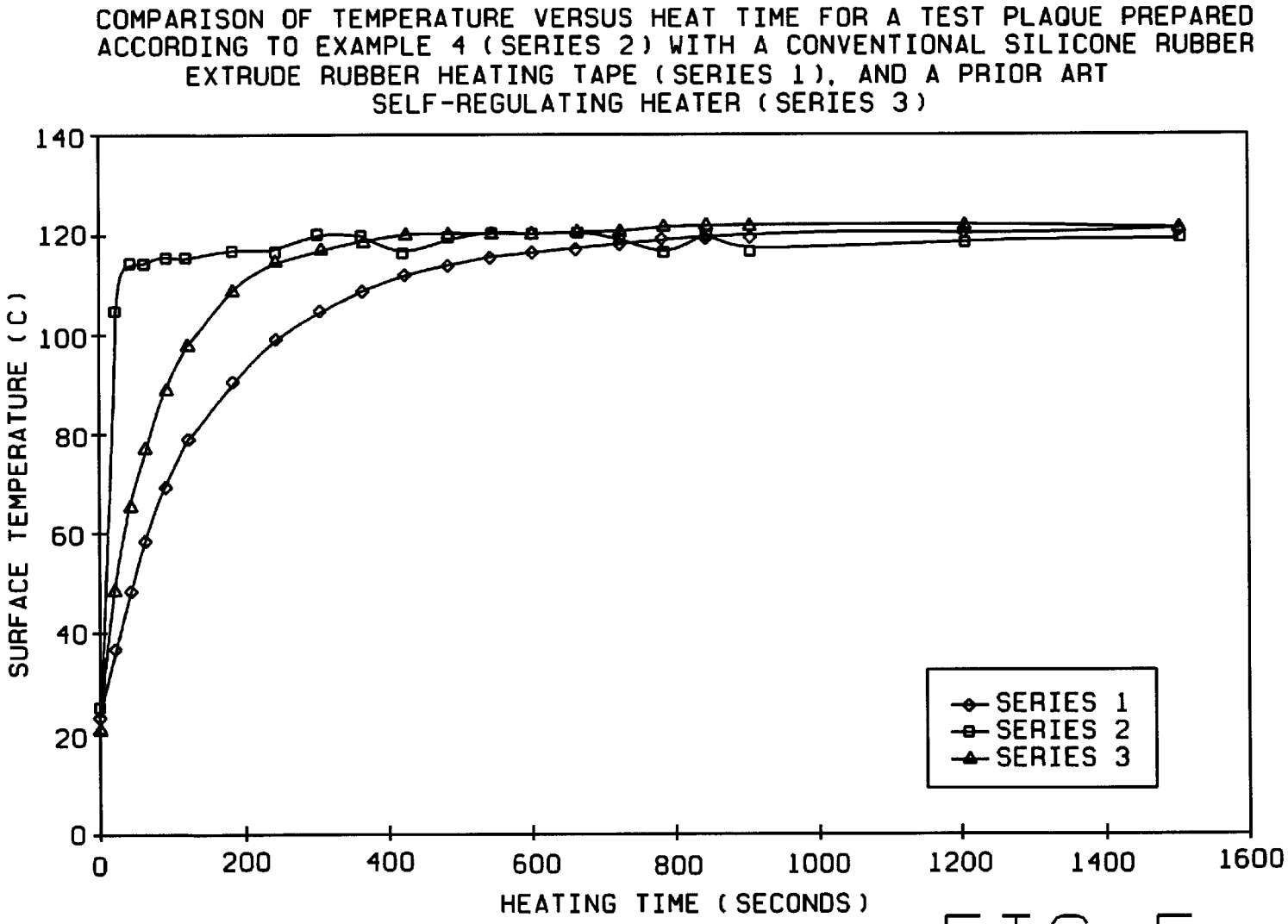

FIG. 5 shows a comparison of temperature versus time for heat-up from room temperature of the sample prepared according to Example 4 with those of a prior art "self-regulating" heater and a heating tape made of extruded silicone rubber. As with Example 3, the present invention shows much faster heat-up than the prior art, with much sharper turnoff. The heater attains 95% of its final temperature within 40 seconds.

While the foregoing is directed to the preferred embodiments of the present invention, other and further embodiments of the invention may be devised without departing from the basic scope thereof, and the scope thereof is determined by the claims which follow.

What is claimed is:

1. A positive temperature coefficient composition comprising:

a polyurethane shape-memory polymer; and an electrically conductive particulate material dispersed spatially evenly throughout said polyurethane shape-memory polymer.

2. The positive temperature coefficient composition of claim 1, wherein said polyurethane shape-memory polymer exhibits a thermal expansion at a glass transition temperature region, said glass transition temperature region occurring within a bandwidth of 40° C. or less.

3. The positive temperature coefficient composition of claim 2, wherein said glass transition temperature region occurs within a bandwidth of 20° C. or less.

4. The positive temperature coefficient composition of claim 3, wherein said glass transition temperature region occurs within a bandwidth of 10° C. or below.

5. The positive temperature coefficient composition of claim 2, wherein said polyurethane shape-memory polymer exhibits a change in modulus of elasticity as measured between 10° C. below and 10° C. above said glass transition temperature, by a factor of 10 or more.

6. The positive temperature coefficient composition of claim 5, wherein said polyurethane shape-memory polymer exhibits a change in modulus of elasticity as measured between 10° C. below and 10° C. above its glass transition temperature, by a factor of 100 or more.

7. The positive temperature coefficient composition of claim 6, wherein said polyurethane shape-memory polymer exhibits a change in modulus of elasticity as measured between 10° C. below and 10° C. above its glass transition temperature, by a factor of 200 or more.

8. The positive temperature coefficient composition of claim 2, wherein said composition is substantially conductive in regions below said glass transition temperature range and substantially electrically insulating in regions above said glass transition temperature range.

9. The positive temperature coefficient composition of claim 8, wherein said electrically conductive particulate material consists of thermal carbon black particles.

10. The positive temperature coefficient composition of claim 9, wherein said thermal carbon black particles are spherical in shape.

11. The positive temperature coefficient composition of claim 10, wherein said thermal carbon black particles have a dibutylphthalate absorption rating below 50 $cm^3$ per 100 grams of said thermal carbon black particles.

12. The positive temperature coefficient composition of claim 10, wherein said thermal carbon black particles are between 0.1 and 0.8 microns in diameter.

13. The positive temperature coefficient composition of claim 8, further comprising one or more electrically insulating additives for affecting the temperatures of said glass transition temperature region.

14. The positive temperature coefficient composition of claim 13, wherein said additives exhibit a phase transition when heated.

* * * * *

UNITED STATES PATENT AND TRADEMARK OFFICE

CERTIFICATE OF CORRECTION

PATENT NO. : 5,902,518
DATED : May 11, 1999
INVENTOR(S) : Khazai, et al

It is certified that error appears in the above-identified patent and that said Letters Patent is hereby corrected as shown below:

on the title page, item [73], delete "Watlow Missouri, Inc., Fenton. Mo.; Northwestern University, Evanston, Ill" and insert – Northwestern University, Evanston, Ill. (part interest) --

Signed and Sealed this

Sixteenth Day of November, 1999

*Attest:*

Q. TODD DICKINSON

*Attesting Officer*

*Acting Commissioner of Patents and Trademarks*